US006231433B1

(12) United States Patent
Brechemier et al.

(10) Patent No.: US 6,231,433 B1
(45) Date of Patent: May 15, 2001

(54) BLANK CLAMPING DEVICE FOR A MACHINE FOR TRIMMING OPTICAL LENSES

(75) Inventors: Bernard Brechemier, Joinville-le-Pont; Michel Nauche, Soisy-sous-Montmorency, both of (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 0 days.

(21) Appl. No.: 09/425,062

(22) Filed: Oct. 22, 1999

(30) Foreign Application Priority Data

Oct. 22, 1998 (FR) ..... 98 13262

(51) Int. Cl.[7] ..... B24B 41/04
(52) U.S. Cl. ..... 451/384
(58) Field of Search ..... 451/384, 390, 451/388, 397, 398, 43, 255, 256

(56) References Cited

U.S. PATENT DOCUMENTS 1,184,496 * 5/1916 Stenvall ..... 451/384
2,293,291 * 8/1942 Gaspari ..... 451/255
3,738,065 * 6/1973 Tagnon ..... 451/384
5,421,770 * 6/1995 Bobst ..... 451/390

FOREIGN PATENT DOCUMENTS 1 947 009 3/1971 (DE) .
2 226 824 11/1974 (FR) .
1 477 126 6/1977 (GB) .
57-201160 12/1982 (JP) .

* cited by examiner

*Primary Examiner*—Robert A. Rose
(74) *Attorney, Agent, or Firm*—Young & Thompson

(57) ABSTRACT

A machine for trimming optical lenses includes two coaxial clamping jaws for clamping faces of a blank provided with bearing arrangements each of which cooperates with one face of the blank. At least one of the jaws includes a plate and a body. The plate carries one of the bearing members and is articulated to the body by a male member carried by one of the two parts constituting the plate/body combination and cooperating with a blind female housing in the other of the two parts. The male member has at least three facets evenly distributed about its axis and each facet is generally cylindrical with generatrices orthogonal to the axis and on respective opposite sides of a common transverse plane. The female housing has plane faces parallel to its axis and each of which is delimited axially by a bottom and cooperates with one of the facets of the male member.

10 Claims, 2 Drawing Sheets

BLANK CLAMPING DEVICE FOR A MACHINE FOR TRIMMING OPTICAL LENSES

BACKGROUND OF THE INVENTION

1. Field of the Invention

The present invention is a blank clamping device for a machine for trimming optical lenses.

2. Description of the Prior Art

Spectacle lenses must be held in place relative to the tools of a grinding machine for trimming the lens.

During trimming, the lens must be held rigidly on an axis about which it is turned to form the various radii constituting the required shape. The axis may correspond to the optical center of the lens of the patient or to the geometrical center of the shape, for example, and does not coincide with the center of the blank. In addition to this, the great variety of geometrical shapes of the concave and convex surfaces of the lenses means that it is not possible to hold the blank in place by means of rigid interfaces.

Existing blank clamping devices for machines for trimming optical lenses have two jaws for clamping concentric faces of the blank fitted with bearing members each of which cooperates with one face of the blank, at least one of the jaws including a body and a plate carrying one of the bearing members and articulated to the body by a ball-and-socket joint.

In an arrangement of this kind the perpendicular to the mean tangent of the surface to be clamped is clearly apparent regardless of the inclination of the perpendicular and the arrangement can therefore accept all geometrical lens shapes.

However, the problem arises of transmitting rotational torque through a ball-and-socket joint. Torque can be transmitted only by friction between the male and female members of the joint, which cannot be increased by increasing the clamping force, as this would break or damage the blank, and which degrades the performance of the ball-and-socket joint.

A previous proposal for transmitting a torque in a ball-and-socket joint is such that the surfaces "stick". Apart from the fact that transmission is then not very positive, this proposal has the drawback of requiring manual "unsticking" of the two components of the ball-and-socket joint after each operation, to avoid breaking the lens.

Another proposal associates two orthogonal pins with the two spherical members of the ball-and-socket joint. This arrangement leads to transmission of torque with too great an angular play, which can be measured in degrees.

An object of the invention is to avoid the above drawbacks and to propose a clamping device incorporating a ball-and-socket joint which improves the performance of the trimming machine in terms of speed of machining, fidelity of shapes and compliance with dimensions and with the axis of the lens.

SUMMARY OF THE INVENTION

The invention consists in a device for clamping a blank on a machine for trimming optical lenses, which machine includes two coaxial clamping jaws for clamping faces of the blank and in which machine each jaw is provided with bearing means adapted to cooperate with one face of the blank, at least one of the jaws includes a plate and a body and the plate carries one of the bearing members and is articulated to the body by a male member carried by one of the two parts of the plate/body combination and cooperating with a blind female housing in the other of the two parts, in which device the male member has at least three facets evenly distributed about its axis, each facet is generally cylindrical with generatrices orthogonal to the axis on respective opposite sides of a common transverse plane, and the female housing has plane faces parallel to its axis and each of which is delimited axially by a bottom and is adapted to cooperate with one of the facets of the male member.

The male member preferably has six facets and the female housing preferably has six plane faces.

The back of the female housing is advantageously frustoconical. Alternatively, the back of the female housing is hemispherical.

The bearing member carried by the plate is advantageously semi-elastic.

The articulation of the plate to the body is preferably protected by a bellows clipped peripherally to the plate at one end and to the body at the other end.

The male member is advantageously carried by the body and the female housing is advantageously formed in the plate.

One of the jaws being fixed and the other being movable in the axial direction, it is preferably the movable jaw which includes the plate and the body.

In one embodiment of the invention, the trimming machine comprising a clamping spindle, the body is hollow and adapted to be mounted at the end of the clamping spindle, to which it is fastened.

Alternatively, the trimming machine comprising a clamping spindle, the body consists of the end of the clamping spindle.

For a better understanding of the object of the invention, one embodiment of the invention will now be described by way of illustrative and non-limiting example only and with reference to the accompanying drawings.

DETAILED DESCRIPTION OF THE PREFERRED EMBODIMENTS

Figure 1:
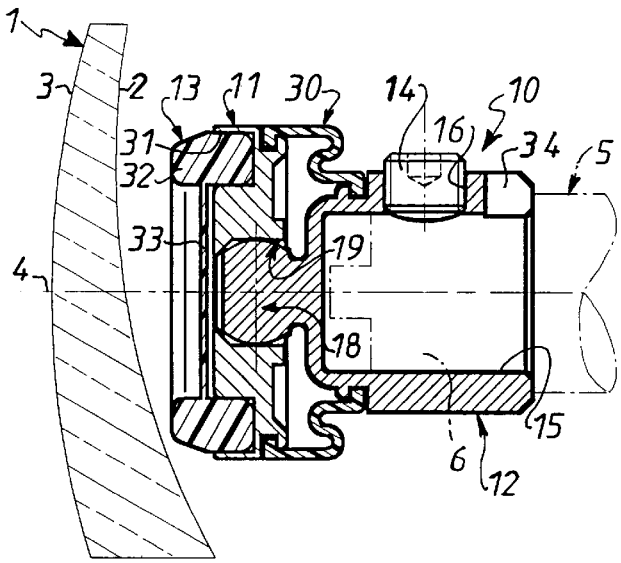
FIG. 1 shows in cross section the mobile jaw of a clamping device of the invention in its rest position.

The clamping device of the invention shown in FIGS. 1 to 9 includes a clamping jaw 10 incorporating a plate 11 and a body 12. The plate 11 carries a bearing member 13 adapted to cooperate with the concave face 2 of a blank 1 to be trimmed. Another, fixed jaw, not shown, centered like the clamping jaw 10 on the axis 4 of the blank 1, which here is its optical axis, cooperates with the convex face 3 of the blank 1. The fixed jaw that is not shown conventionally carries an elastic bearing member, of the sucker type, against which the blank 1 is "squashed" by the clamping jaw 10 through the intermediary of its relatively elastic bearing member 13.

Here the body 12 is hollow and incorporates a blind cylindrical housing 15 by means of which the clamping jaw 10 is mounted on the tip 6 of a spindle 5 of the trimming machine concentric with the axis 4. A grubscrew 14 screwed into a screwthreaded hole 16 through the wall of the body 12 attaches the body 12 to the tip 6 of the spindle 5.

The rotation torque is transmitted by a radial pin, not shown, which engages in a notch 34 in the body 12.

Running from its front transverse wall 17, which delimits its blind cylindrical housing 15, the body 12 carries a male member 18 adapted to cooperate with a female housing 19 in the plate 11.

Figure 2:
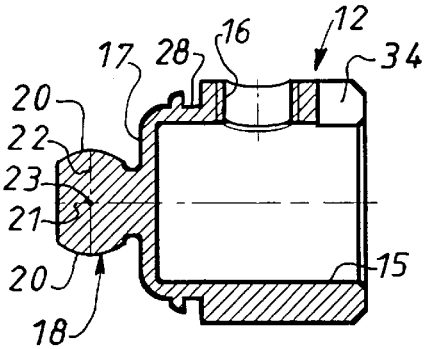
FIG. 2 shows the body only of the jaw from FIG. 1 in cross section taken along the line II—II in FIG. 3.
Figure 4:
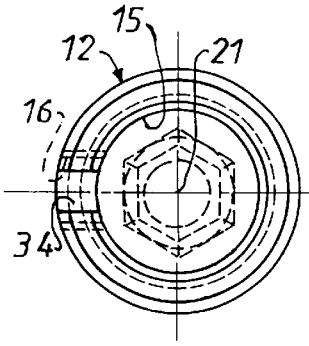
Figure 3:
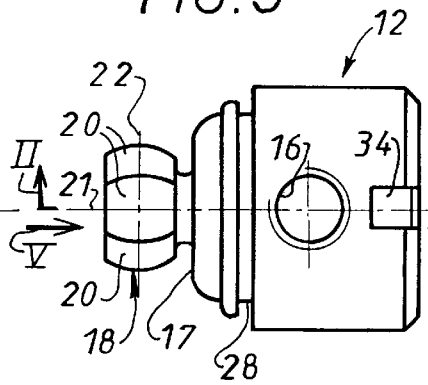
FIG. 3 is a plan view of the body from FIG. 2 and FIGS. 4 and 5 are respectively righthand and lefthand side views relative to FIG. 3, as seen in the directions of the arrows IV and V in FIG. 3, respectively.
Figure 5:
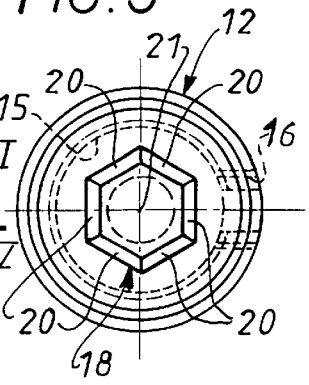
Figure 7:
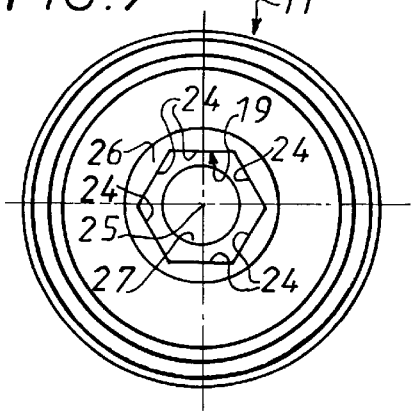
FIG. 7 is a righthand side view relative to FIG. 6.
Figure 6:
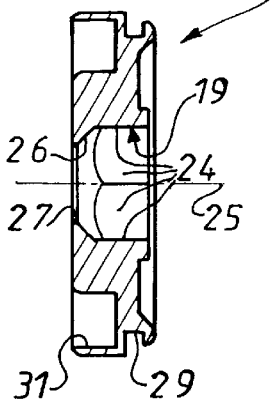
FIG. 6 shows the plate only of the jaw from FIG. 1 in cross section.
Figure 8:
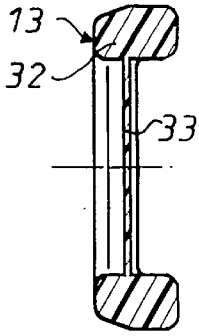
FIG. 8 shows the bearing member of the jaw from FIG. 1 in section.

The male member 18 has six facets 20 evenly distributed about its axis 21. Each facet 20 is generally cylindrical with the generatrices orthogonal to said axis 21. The two opposite facets 20 that can be seen in section in FIG. 2 therefore have their generatrices perpendicular to the plane of the figure. The generatrices, and therefore the facets 20, lie on respective opposite sides of a common transverse plane 22, advantageously symmetrically about the plane 22. Their intersection with the plane of FIG. 2 is preferably a circular arc concentric with the axis at the point 23 where the axis 21 intersects said transverse plane 22.

The female housing 19 has plane faces 24 parallel to the axis 25 of the plate 11. The female housing 19 has as many faces 24 evenly distributed in the circumferential direction as there are facets 20 on the male member 18, each face 24 being intended to cooperate with one facet 20.

Here the bottom 26 is frustoconical in shape and concentric with the axis 25.

In a variant that is not shown, the bottom 26 is hemispherical.

Here the bottom 26 has a circular central opening 27 corresponding to the smaller diameter face when the bottom 26 is frustoconical.

On the side facing the blank 1 to be trimmed, the plate 11 has an annular recess 31 intended to receive the semi-elastic material bearing member 13. To be more precise, the bearing member 13 comprises a web 33 surrounded by an annular ring 32 housed in the annular recess 31 in the plate 11. Here the central opening 27 in the bottom 26 of the female housing 19 facilitates fitting the bearing member 13. Alternatively, the bottom of the female housing 19 is solid and the bearing member 13 includes only the ring 32.

Figure 9:
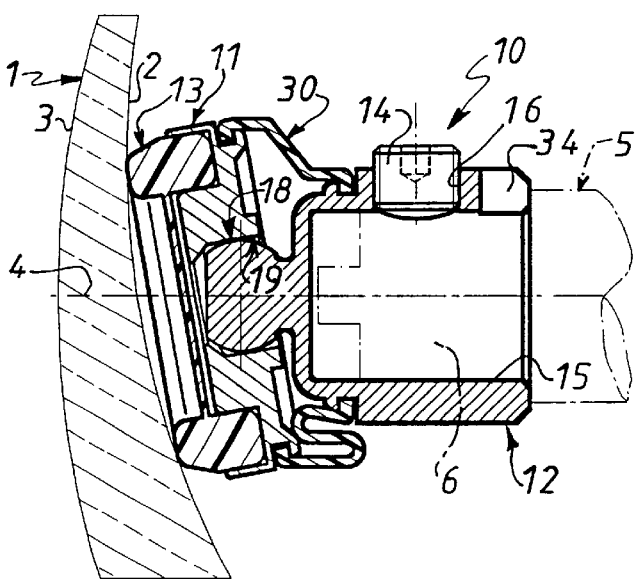
FIG. 9 shows the jaw from FIG. 1 in section in an operational position.

By virtue of the articulation just described, the plate 11 and the body 12 are constrained to rotate together, through cooperation of the facets 20 with the faces 24. Also, this cooperation authorizes the plate 11 to move angularly relative to the body 12. The bearing member 13 carried by the plate 11 can then be pressed onto the concave face 2 of the blank 1, regardless of the angle of the mean tangent to that face, as shown in FIG. 9. Also, the cooperation of the facets 20 on the male member 18 with the bottom 26 of the female housing 19 transmits the clamping force along the axis 4 regardless of the angle in question.

Thus the articulation of the invention functions like a ball-and-socket joint whilst constraining the male member 18 of the body 12 to rotate with the female housing 19 in the plate 11. The presence of six facets and six faces disposed in a hexagon and facing each other in pairs provides a ball-and-socket effect that is symmetrical from the point of view of the angles of relative angular motion between the plate 11 and the body 12. Also, this hexagonal arrangement produces an articulation that has virtually no rotational play and the manufacturing cost is reasonable. In contrast, an even number of facets and faces greater than six would require a very small rotational play, which would increase the unit cost of manufacture.

Of course, variants are possible. A variant with three or five facets and three or five faces would be equally serviceable. The ball-and-socket effect would be easily obtained about an axis parallel to the plane faces. Also, relative movement would be limited. Be this as it may, the relative movement would not be symmetrical about the direction of relative movement. A variant with four facets and four faces would also work easily and symmetrically about an axis parallel to two parallel faces, although the relative movement would be more limited.

The articulation is advantageously protected, if only from chips produced during trimming, by an elastic rubber bellows 30 which surrounds it. One end of the bellows 30 is clipped into a groove 28 on the body 12 and the other end into a groove 29 on the plate 11. The bellows 30 is preferably mounted under tension between the plate 11 and the body 12. It therefore assembles these two members together in a simple and readily demountable fashion, whilst assuring permanent contact between the male member 18 and the back 26 of the female housing 19, the articulation having no axial play. Note also that, because of the bellows 30, on releasing the clamping action, the plate 11 and the body 12 automatically resume their original concentric positions, as shown in FIG. 1.

Figure 10:
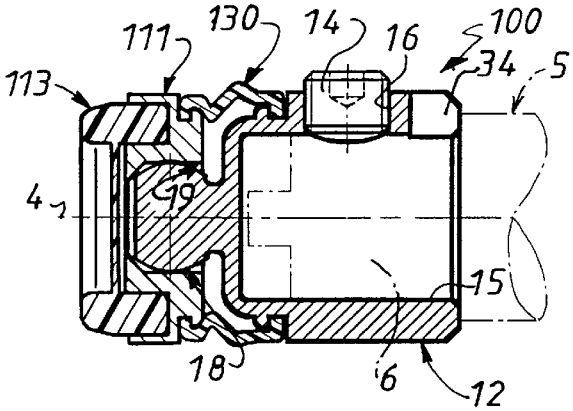
FIG. 10 is analogous to and shows a variant of FIG. 1.

Of course, different plates could be associated with the same body: accordingly, in FIG. 10, the clamping device 100 includes a body 12 analogous to that of the previous device 10 and a plate 111 having a smaller diameter than the previous plate 11. The plate 111 has a bearing member 113 and a female housing 19 adapted to cooperate with the male member 18 of the body 12. A bellows 130 assembles the plate 111 to the body 12.

In the examples shown, the body 12 is designed to be mounted on the spindle 5 of the trimming machine. alternatively, the end of the spindle 5 can itself be shaped like the body 12.

The structures can equally be interchanged. Accordingly, in one variant, the female housing 19 is in the body 12 and the plate 11 carries the male member 18.

There is claimed:

1. A device for clamping a blank on a machine for trimming optical lenses, which machine includes two coaxial clamping jaws for clamping faces of said blank and in which machine each jaw is provided with bearing members adapted to cooperate with one face of said blank, at least one of said jaws includes a plate and a body and said plate carries one of said bearing members and is articulated to said body by a male member having a first axis and being carried by one of said two parts of the plate/body combination and cooperating with a blind female housing in the other of said two parts, in which device said male member has at least three facets evenly distributed about said first axis, each facet is generally cylindrical with generatrices orthogonal to said first axis on respective opposite sides of a common transverse plane, and said female housing having a second axis and plane faces parallel to said second axis, and each of said faces being delimited axially by a bottom and adapted to cooperate with one of said facets of said male member.

2. The device claimed in claim 1 wherein said male member has six facets and said female housing has six plane faces.

3. The device claimed in claim 1 wherein said bottom of said female housing is frustoconical.

4. The device claimed in claim 1 wherein said bottom of said female housing is hemispherical.

5. The device claimed in claim 1 wherein said bearing member carried by said plate is semi-elastic.

6. The device claimed in claim 1 wherein said articulation of said plate to said body is protected by a bellows clipped peripherally at one end to said plate and at the other end to said body.

7. The device claimed in claim 1 wherein said male member is carried by said body and said female housing is in said plate.

8. The device claimed in claim 1 wherein one of said jaws is fixed and the other is movable in the axial direction and said movable jaw includes said plate and said body.

9. The device claimed in claim 8 for use when said trimming machine comprises a clamping spindle and wherein said body is hollow and adapted to be mounted at the end of said clamping spindle, to which it is fastened.

10. The device claimed in claim 8 for use when said trimming machine includes a clamping spindle and wherein said body is the end of said clamping spindle.

* * * * *